US005540387A

United States Patent [19]

Reiter et al.

[11] Patent Number: 5,540,387

[45] Date of Patent: Jul. 30, 1996

[54] DEVICE FOR INJECTING A FUEL/GAS MIXTURE

[75] Inventors: Ferdinand Reiter, Markgröningen; Heinz-Martin Krause, Ditzingen; Martin Maier, Möglingen; Jürgen Buchholz, Lauffen, all of Germany

[73] Assignee: Robert Bosch GmbH, Stuttgart, Germany

[21] Appl. No.: 356,277

[22] PCT Filed: Apr. 7, 1994

[86] PCT No.: PCT/DE94/00386

§ 371 Date: Feb. 16, 1995

§ 102(e) Date: Feb. 16, 1995

[87] PCT Pub. No.: WO94/24434

PCT Pub. Date: Oct. 27, 1994

[30] Foreign Application Priority Data

Apr. 20, 1993 [DE] Germany ..... 43 12 756.8

[51] Int. Cl.[6] ..... F02M 61/00; F02M 51/00

[52] U.S. Cl. ..... 239/408; 239/417.3; 239/432/434; 239/585.1; 239/596

[58] Field of Search ..... 239/585.1–585.5, 239/533.12, 429, 434, 596, 431, 417.3, 408, 432

[56] References Cited

U.S. PATENT DOCUMENTS

| | | | |
|---|---|---|---|
| 4,771,948 | 9/1988 | Furukawa et al. | 239/562 X |
| 4,957,241 | 9/1990 | Roger . | |
| 4,982,716 | 1/1991 | Takeda et al. . | |
| 5,016,819 | 5/1991 | Wood | 239/585.1 X |
| 5,100,102 | 3/1992 | Schechter | 239/585.4 |
| 5,174,505 | 12/1992 | Shen | 239/585.1 X |
| 5,402,937 | 4/1995 | Buchholz et al. | 239/585.5 X |

FOREIGN PATENT DOCUMENTS

| | | | |
|---|---|---|---|
| 3716402 | 11/1987 | Germany . | |
| 4121372 | 3/1992 | Germany . | |
| 2245470 | 10/1992 | Japan . | |
| 2225809 | 1/1989 | United Kingdom | 239/533.12 |
| 92/14052 | 8/1992 | WIPO . | |

*Primary Examiner*—Kevin P. Weldon
*Attorney, Agent, or Firm*—Kenyon & Kenyon

[57] ABSTRACT

A device has a jet divider with a convex divider surface facing the perforated spray disc. The convex jet divider acts as a flow resistance, thereby causing stagnation region flow. The stagnation-region flow is responsible for the fact that, despite the gas containing, separation of the jets is maintained even downstream of the jet divider (86) and for the good preparation effect of the gas containing by virtue of improved mixing of the gas and fuel. The device for injecting a fuel/gas mixture is suitable particularly for injection into the intake pipe of a mixture-compressing internal combustion engine having externally supplied ignition.

21 Claims, 6 Drawing Sheets

DEVICE FOR INJECTING A FUEL/GAS MIXTURE

FIELD OF THE INVENTION

The present invention relates to a device for injecting a fuel/gas mixture.

BACKGROUND INFORMATION

An electromagnetically actuable valve for injecting a fuel/gas mixture into a mixture-compressing internal combustion engine having externally supplied ignition is already known (German Patent application No. 41 21 372), in the case of which a gas containing sleeve surrounds a nozzle body of a fuel injection valve. The gas containing sleeve is designed in such a way that its bottom part, which has a concentric passage opening, is formed obliquely towards the valve end of the fuel injection valve. An annular gas gap is formed in this way between a perforated (apertured) spray disc and the bottom part of the gas containing sleeve. The gas stream emerging from the annular gas gap is directed radially at the individual fuel jets emerging from the perforated spray disc and causes the fuel jets to approach one another and may even cause them to unite into a single fuel jet.

Also known is an injection valve for injecting a fuel/gas mixture (U.S. Pat. No. 4,957,241) in which a spacer plate for influencing the air rate is installed between a nozzle body and a protective cap. The spacer plate between the nozzle body and the protective cap has a central opening into which the downstream pintle end of a valve needle projects. The air supply to the fuel emerging from a fuel passage is accomplished via air passages and air chambers. Here, the radial air supply to the pintle of the valve needle is determined by the height of, for example, four spacer knobs formed on the spacer plate. In the final analysis, however, the quantity and composition of the fuel/air mixture is determined by the size of the axially extending annular gap between the pintle of the valve needle and the circumference of the opening in the spacer plate.

German Patent application No. 37 16 402 has furthermore disclosed injection valves with a perforated plate in which there are formed two spray holes (also referred to as spray-discharge orifices) from which fuel jets emerge, these being targeted at different deflection surfaces of a prismatic deflection body and being deflected there in desired directions. However, the fuel is not surrounded by a gas and there is thus no risk that the fuel jets will move towards one another.

Likewise known are injection valves (U.S. Pat. No. 4,982,716) in which an impact surface is provided downstream of the single spray opening, the single fuel jet sprayed striking the impact surface and being guided in the form of a film into two spray passages, an air jet being directed at the fuel films formed after the impact.

SUMMARY OF THE INVENTION

The device according to the present invention for injecting a fuel/gas mixture forms an easily assembled and simple to adjust device for the improved preparation of fuel by the supply of a fixed gas quantity while maintaining the desired separation into two jets. This provides the advantage that, in contrast to wedge-shaped or knife edged jet dividers, gas backs up above the divider surface in the case of jet dividers with a convex divider surface, the fuel jets being forced outwards away from one another by the stagnation (back) pressure of the gas and the separation into two jets is thus maintained. The convex jet divider acts as a flow resistance, causing a stagnation-region flow. The stagnation-region flow is responsible for the fact that the separation into two jets is maintained despite gas containing, even downstream of the jet divider and for the good preparation effect of the gas containing by virtue of improved mixing of the gas and fuel.

It is particularly advantageous to employ jet dividers with convex divider surfaces which have circular, semi-circular or elliptical cross-sections. For particular desired jet angles, it is advantageous if the jet dividers have waist-like constrictions or bulges with convex divider surfaces.

It is advantageous to clamp a sheet-metal insert with spacers, for example integrally formed knobs, between a perforated spray disc and a gas containing body. The metering of the gas for improved preparation of the fuel is accomplished by means of the specially shaped sheet-metal inert and the knobs integrally formed in a dimensionally accurate manner. The sheet-metal insert is pressed against the perforated spray disc by a section of the gas containing body which tapers upstream in the form of a truncated cone and rests at least partially against a conical region of the sheet-metal insert. The inserted sheet-metal inert is precentered by means of radially outward-pointing tabs on the sheet-metal insert. Fine adjustment is achieved by pressing the gas containing body. A differential angle of taper formed between the sheet-metal insert and the gas containing body guarantees axial tolerance compensation as regards the sheet-metal insert and the gas containing body relative to the perforated spray disc. By means of this clamping and the associated differential angle of taper, a seal is achieved, thus preventing fuel from entering gas-guiding passages and flow passages.

DETAILED DESCRIPTION

Figure 1:
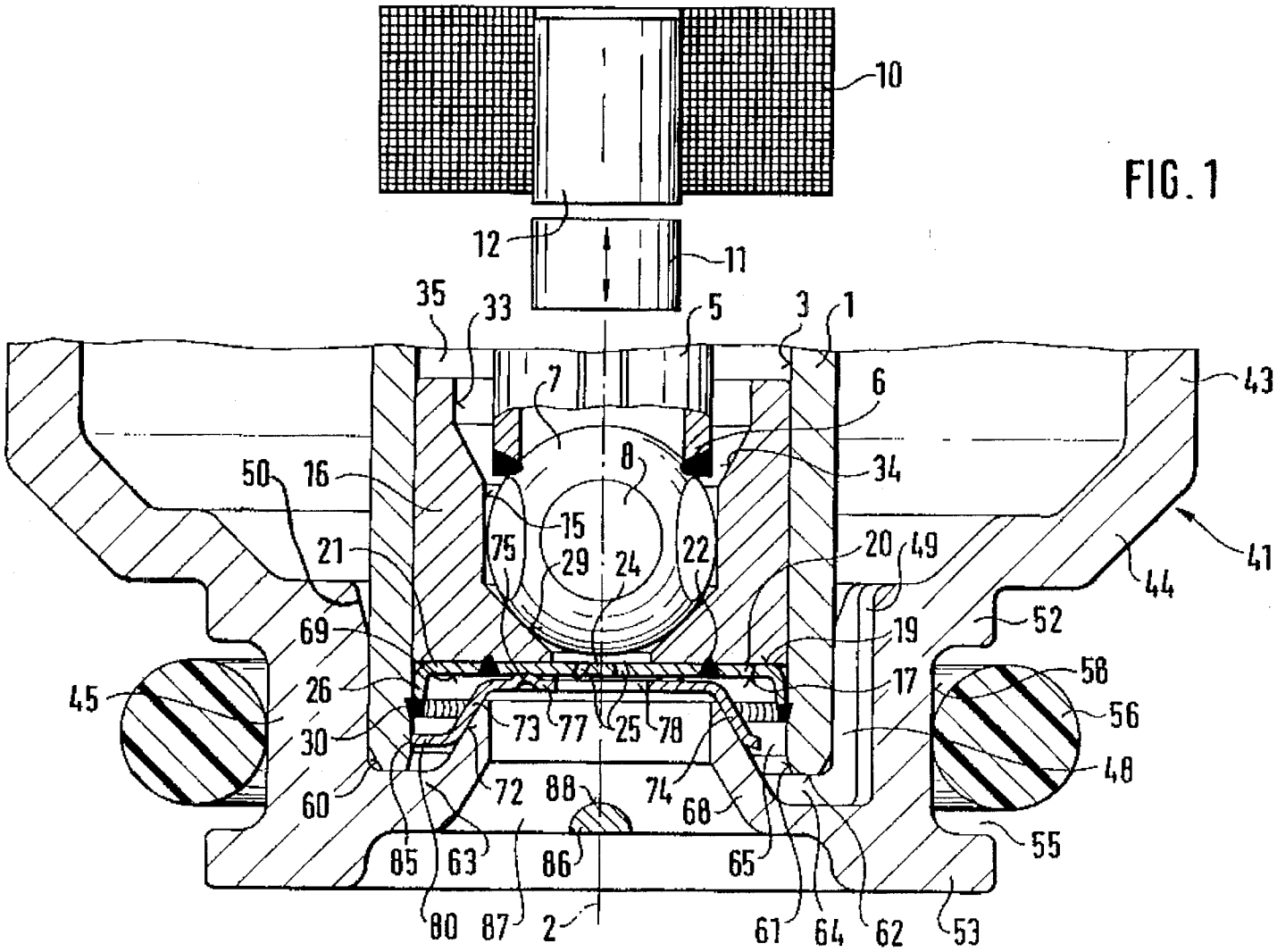
FIG. 1 shows a partial view of a device for injecting a fuel/gas mixture in accordance with a first exemplary embodiment according to the present invention.

FIG. 1 shows, partially and in simplified form, an exemplary embodiment of a valve in the form of an injection valve for fuel injection systems of mixture-compressing internal combustion engines having externally supplied ignition. The injection valve has a tubular valve-seat carrier 1 in which a longitudinal opening 3 is formed concentrically with a valve longitudinal axis 2. Arranged in the longitudinal opening 3 there is a valve needle 5, which is, for example, tubular and is provided at its downstream end 6 with a valve closing body (also referred to as a valve-closure member) 7, which is, for example, spherical and on the circumference of which there are, for example, five flattened areas 8.

The injection valve is actuated in a known manner, for example electromagnetically. For axial movement of the valve needle 5 and hence opening counter to the spring force of a return spring (not shown) or closure of the injection valve use is made of an indicated electromagnetic circuit with a magnet coil 10, an armature 11 and a core 12. The armature 11 is connected to the end of the valve needle 5 remote from the valve closing body 7 by means of, for example, a laser weld and is aligned with the core 12. The magnet coil 10 surrounds the core 12, which, for example, forms the end, surrounded by the magnet coil 10, of an inlet branch (not shown specifically) which serves for the supply of the medium to be metered in by means of the valve, here fuel.

To guide the valve-closing body 7 during the axial movement, use is made of a guide opening 15 in a valve-seat body 16. The cylindrical valve-seat body 16 is installed leak-tightly (imperviously)—by welding—in the longitudinal opening 3 extending concentrically to the valve longitudinal axis 2. The circumference of the valve-seat body 16 has a slightly smaller diameter than the longitudinal opening 3 of the valve-seat carrier 1. At one end 17, the lower end remote from the valve-closing body 7, the valve-seat body 16 is rigidly and concentrically connected to a bottom part 20 of a perforated spray disc 21 of, for example, cup-shaped design and the bottom part 20 thus rests by its upper end 19 against the lower end 17 of the valve-seat body 16. The connection between the valve-seat body 16 and the perforated spray disc 21 is formed, for example, by an encircling (circumferential) and leak-tight first weld 22 on the bottom part 20, the weld being formed, for example, by means of a laser. This mounting method avoids the risk of unwanted deformation of the bottom part 20 in the area of its spray openings 25, of which there are at least two, for example four, which are formed by punching or erosion and are situated in a central area 24 of the bottom part 20.

Adjoining the bottom part 20 of the cup-shaped perforated spray disc 21 is an encircling retaining rim 26 which extends in the axial direction on the side facing away from the valve-seat body 16 and is bent outwards conically as far as its downstream end. At its end, the retaining rim 26 has a larger diameter than the diameter of the longitudinal opening 3 of the valve-seat carrier 1. Since the circumferential diameter of the valve-seat body 16 is smaller than the diameter of the longitudinal opening 3 of the valve-seat carrier 1, there is radial pressure only between the longitudinal opening and the retaining rim 26—bent outwards with a light conicity—of the perforated spray disc 21. The retaining rim 26 exerts a radial spring action on the wall of the longitudinal opening 3. This prevents the formation of a shaving on the valve-seat part and on the longitudinal opening 3 when the valve-seat part consisting of the valve-seat body 16 and the perforated spray disc 21 is pushed into the longitudinal opening 3 of the valve-seat carrier 1.

The depth to which the valve-seat part consisting of the valve-seat body 16 and the cup-shaped perforated spray disc 21 is pushed into the longitudinal opening 3 determines the presetting of the stroke of the valve needle 5 since one end position of the valve needle when the magnet solenoid coil 10 is not excited—is determined by the contact of the valve-closing body 7 with the valve-seat surface 29 of the valve-seat body 16. The other end position of the valve needle 5—when the magnet coil 10 is excited—is determined, for example, by the contact of the armature 11 with the core 12. The distance between these two end positions of the valve needle 5 thus represents the stroke.

At its downstream end, the retaining rim 26 of the perforated spray disc 21 is connected to the wall of the longitudinal opening 3 by means of an encircling and leak-tight second weld 30, for example. Like the first weld 22, the second weld 30 is, for example, formed by means of a laser. In laser welding, the heating of the parts to be welded together is slight and the method is safe and reliable. A leak-tight weld between the valve seat body 16 and the perforated spray disc 21 and between the perforated spray disc 21 and the valve-seat carrier 1 is necessary to ensure that the fuel cannot flow between the longitudinal opening 3 of the valve-seat carrier 1 and the circumference of the valve-seat body 16 to the spray openings 25 or between the longitudinal opening 3 of the valve-seat carrier 1 and the retaining rim 26 of the cup-shaped perforated spray disc 21 directly into an intake conduit (intake line) of the internal combustion engine. With the two welds 22 and 30, there are thus two fixing points on the cup-shaped perforated spray disc 21.

The spherical valve-closing body 7 interacts with the valve-seat surface 29 of the valve-seat body 16, the surface being formed axially between the guide opening 15 and the lower end 17 of the valve-seat body 16 and tapering in the form of a truncated cone in the direction of flow. Facing the magnet coil 10, the valve-seat body 16 has a valve-seat body opening 33 which has a larger diameter than the guide opening 15 of the valveseat body 16. A section 34 adjoining the valve-seat body opening 33 in the direction of the perforated spray disc 21 is distinguished by its frustoconical taper down to the diameter of the guide opening 15. The valve-seat body opening 33 with its following frustoconical section 34 serves as a flow inlet to allow flow of the medium from a valve interior space 35 bounded in the radial direction by the longitudinal opening 3 of the valve-seat carrier 1 to the guide opening 15 of the valve-seat body 16.

To ensure that the flow of the medium also reached the spray openings 25 of the perforated spray disc 21, five flattened areas 8, for example, are formed on the circumference of the spherical valve-closing body 7. When the injection valve is open, the five circular flattened areas 8 allow the medium to flow through from the valve interior space 35 to the spray openings 25 of the perforated spray disc 21. To provide exact guidance for the valve-closing body 7 and hence the valve needle 5 during the axial movement, the diameter of the guide opening 15 is so designed that, outside of its flattened areas 8, the spherical valve-closing body 7 extends through the guide opening 15 with a small radial clearance.

At its downstream end, the valve-seat carrier 1 is surrounded at least partially in the radial and axial directions by a stepped concentric gas containing body 41. The gas containing body 41, which is made of a plastic, includes, for example, both the actual gas containing at the downstream end of the valve-seat carrier 1 and a gas inlet passage (not shown) which serves to feed the gas into the gas containing body 41 and is, for example, formed integrally with the gas containing body 41. Adjoining an axially extending tubular section 43 of the gas containing body 41, the section being connected, for example, to a plastic extrusion coat of the injection valve axially between the magnet coil 10 and the valve-closing body 7 by ultrasonic welding, is a section 44 which tapers conically in the downstream direction. This conical section 44 is, for example, likewise of stepped design. The design of the gas containing body 41 in this area can be varied to match the spatial conditions of a valve socket (valve seat) (not shown). Section 44 is followed, in turn, in the downstream direction by another axially extending tubular section 45 of the gas containing body 41, this section however being distinguished by a significantly smaller diameter than that of section 43. Axial section 45 surrounds the downstream end of the valve-seat carrier 1 both in direct contact with it and with a radial clearance in order to feed the gas to the fuel emerging from the spray openings 25 of the perforated spray disc 21. In, for example, three to six areas of section 45 of the gas containing body 41, the walls are therefore of thinner design than in the whole of the rest of the area of the circumference. The reduction in the wall thickness of the gas containing body 41 in section 45 has as a consequence that, for example, three to six gas inlet passages 48 are integrally formed between the valve-seat carrier 1 and the gas containing body 41, these passages extending axially and in a regular manner at equal spacings on the circumference of the valve-seat carrier 1, e.g. in the case of three gas inlet passages 48 with an offset of, in each case, 120° or, in the case of six gas inlet passages 48, with an offset of, in each case, 60°.

Section 45 of the gas containing body 41 is designed in such a way that first chamfers 49, which extend axially over the entire length of the gas inlet passages 48, are formed in the areas of the gas inlet passages 48. In addition, section 45 of the gas containing body 41 has, at its upstream end, second chamfers 50, which are formed only on the circumference outside the gas inlet passages 48 and allow simplified assembly when pushing the gas containing body 41 from the downstream side onto the valve-seat carrier 1 and hence onto the injection valve. At its upstream and downstream ends, the axially extending section 45 has respective radially outward-pointing encircling shoulders 52, 53 which, together with the outer wall of section 45, form an annular groove 55. A sealing ring 56 is arranged in the annular groove 55, its side faces being formed by the downstream side of shoulder 52 and the upstream side of shoulder 53 and its groove space 58 by the outer wall of section 45 of the gas containing body 41. The sealing ring 56 serves to provide a seal between the circumference of the injection valve and the gas containing body 41 and a valve socket (not shown), for example in the intake conduit of the internal combustion engine or in a so called fuel and/or gas distributor conduit.

At its downstream end, the valve-seat carrier 1 has an outer encircling taper 60 and an inner encircling taper 61 against which no other components rest and which are intended to improve the assembly of the gas containing body 41 with the injection valve, while the gas containing body 41 rests against a downstream end face 62 of the valve-seat carrier 1 by mean of a radially extending section 63 in the areas outside of the gas inlet passages 48. In order to ensure that the gas flows into a metering cross section, the axially extending gas inlet passages 48 are adjoined by, for example, an equal number, that is, for example, three to six, radially extending flow passages 64, which are formed between the radially extending section 63 of the gas containing body 41 and the downstream end face 62 of the valve-seat carrier 1 on installation of the gas containing body 41 and through which the gas flows radially. The gas then flows axially upstream into an annular passage 65 between a last, concentric section 68 of the gas containing body 41, the section tapering in the form of a truncated cone in the upstream direction, and the wall of the longitudinal opening 3 in the valve-seat carrier 1 until the flow is diverted in the radial direction by a lower end face 69 of the bottom part 20 of the perforated spray disc 21.

In this arrangement, an outer surface 70 of the section 68 of the gas containing body 41, which section projects into the injection valve and hence into the valve-seat carrier 1 in the direction of the perforated spray disc 21, presses at least in part against an inner surface 72 of a conically extending and encircling area 73 of a sheet-metal insert 74 which, in turn, rests against the lower end face 69 of the bottom part 20 of the perforated spray disc 21 by way of spacing elements, for example, knobs 75. With the said of the specially shaped sheet-metal insert 74 and the knobs 75 formed in a dimensionally accurate manner on the latter, the metering of the gas for improved preparation of the fuel emerging from the spray openings 25 of the perforated spray disc 21 is finally accomplished. A sheet-metal insert 74 is formed by a radial area 77 with a mixture spray opening 78 extending in it centrally and concentrically to the valve longitudinal axis 2, the area 73 extending conically and hence obliquely to the valve longitudinal axis 2, and, for example, three tabs 80 pointing radially outwards and adjoining the conically extending area 73 on the downstream side. The knobs 75 are integrally formed on the radial area 77 of the sheet-metal insert 74 at least three point, in which case they are offset by 120°, the knobs having an axial extent in the direction of the perforated spray disc 21 and making point contact with the latter on its lower end face 69 after the installation of the gas containing body 4.

The knobs 75 of the sheet-metal insert 74 are used to define an axial spacing between the lower end face 69 of the perforated spray disc 21 and an upper end face 81 of the radial area 77 of the sheet-metal insert 74 facing the perforated spray disc 21, the spacing corresponding to the axial height of the knobs 75 and hence to the axial extent of an annular gas gap 83 formed thereby. The knobs 75 of the sheet-metal insert 74 are introduced, for example, by an embossing method since it is thereby possible to maintain desired very narrow tolerances for the axial extent. The axial dimension of the extent of the annular gas gap 83 forms the metering cross-section for the gas flowing in from the annular passage 65, for example preparation air. The annular gas gap 83 serves for the supply of the gas to the fuel dispensed through the spray openings 25 of the perforated spray disc 21 and for metering the gas. The gas fed in through the gas inlet passages 48, the flow passages 64 and the annular passages 65 flows through the narrow annular gas gap 83 to the mixture spray opening 78 and there impinges upon the fuel dispensed through the spray openings 25, of which there are, for example, two or four. As a result of the small axial extent of the annular gas gap 83 created by the knobs 75, the gas supplied is highly accelerated and atomizes the fuel particularly finely. As gas, it is, for example, possible to use the intake air branched off by means of a bypass upstream from a throttle valve in the intake pipe of the internal combustion engine, air delivered by an additional blower or, alternatively, recirculated exhaust gas from the internal combustion engine or a mixture of air and exhaust gas.

The mixture spray opening 78 in the radial area 77 of the sheet-metal insert 74 has a diameter large enough to allow the fuel emerging upstream from the spray openings 25 of the perforated spray disc 21, upon which, for the purpose of better preparation, the gas impinges perpendicularly as it comes out of the annular gas gap 83, to emerge unhindered through the mixture spray opening 78 of the sheet-metal insert 74.

Figure 2:
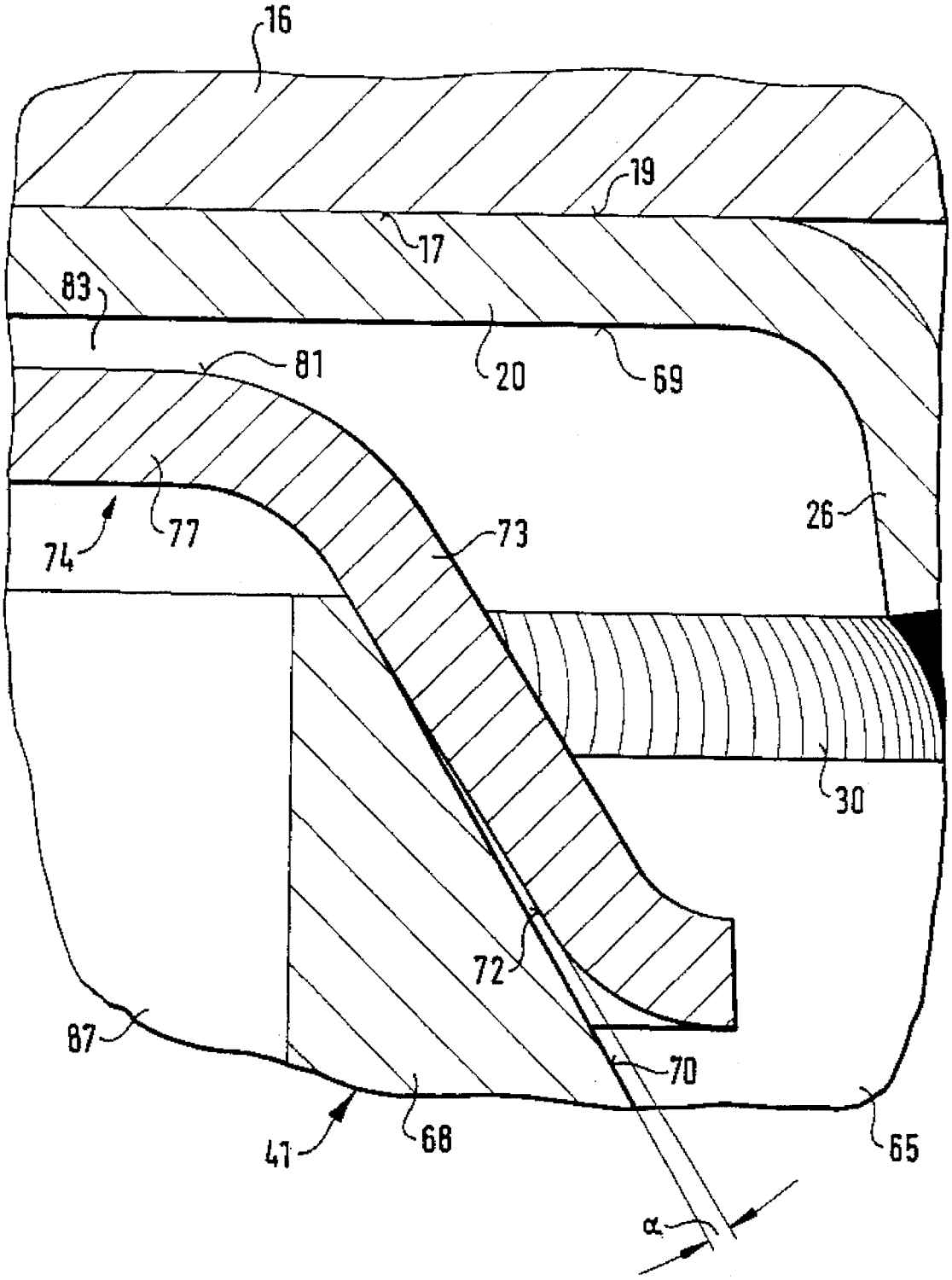
FIG. 2 shows an enlarged partial view of the device shown in FIG. 1.

The sheet-metal insert 74 is pressed against the perforated spray disc 21 by section 68 of the gas containing body 41 which tapers in the form of a truncated cone in the upstream direction and rests at least partially against the inner surface 72 of the conical area 73 of the sheet-metal inert 74. FIG. 2, which is an enlarged partial view showing the detail of FIG. 1, gives a clear illustration of this clamping area. The sheet-metal insert 74 is configured in such a way that adjoining the area 73 on the downstream side, there are, for example, three tabs 80 (FIG. 1), these serving to pre-center the sheet metal insert 74 in the valve-seat carrier 1. The tabs 80 have radial end faces 85 which are obtained, for example, by smooth punching and are of good quality as regards their surface roughness. This ensures that the tabs 80 rest as accurately as possible by their radial end faces 8 against the wall of the longitudinal opening 3 in the valve-seat carrier 1. Fine adjustment of the pre-centered sheet-metal insert 74 is accomplished with the aid of the gas containing body 41, which presses against the conical area 73 of the sheet-metal insert 74. There is line contact between the gas containing body 41 and the sheet metal insert 74 and, as the frusto-conical section 68 of the gas containing body 41 is pushed in further in the upstream direction, this becomes surface contact. A differential angle of taper $\alpha$ inevitably arises between the outer surface 70 of section 68 of the gas containing body 41 and the inner surface 72 of area 73 of the sheet-metal insert 74. This differential angle of taper ensures axial tolerance compensation as regards the sheet-metal insert 74 and the gas containing body 41 relative to the perforated spray disc 21. By means of the clamping of the two components, the sheet-metal insert 74 and the gas containing body 41, and of the associated differential angle of taper $\alpha$, a seal is achieved, preventing fuel from entering the gas-guiding annular passages 65 and flow passages 64.

A jet divider 86 is provided in the gas containing body 41 downstream of the mixture spray opening 78 of the sheet-metal insert 74. The jet divider 86 extends transversely through the valve longitudinal axis 2 and symmetrically divide a spraying space 87, formed by the gas containing body 41, downstream from the mixture spray opening 78. In accordance with the configuration of the gas containing body 41, the spraying space 87 can be of cylindrical design initially, in the direction of flow, and then take on a conical form or can be completely cylindrical or elliptical. Seen in the axial direction, the jet divider 86 is, for example, situated at the same level as the radially extending section 63 of the gas containing body 41 and thus also forms the connection between two points of section 63 situated 180° apart. The jet divider 86 can either take the form of a web, forming part of the plastic gas containing body 41 or can, for example, be installed in addition in the form of a pin made from a different material. The decisive factor in the design of the jet divider 86 is the formation of an upper convex divider surface 88 facing upstream.

Figure 3:
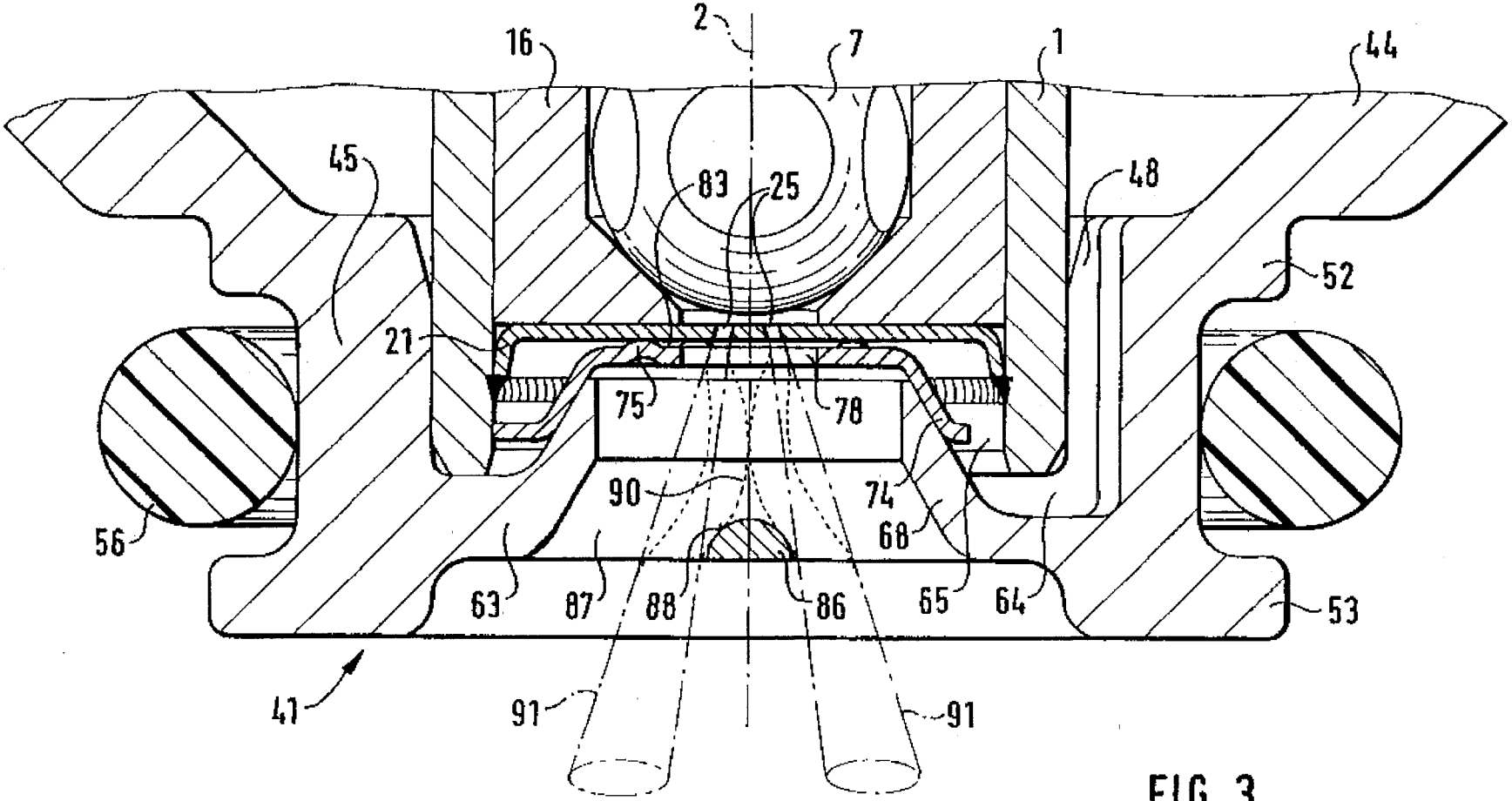
FIG. 3 shows the action of a jet divider with a convex divider surface.

FIG. 3 is intended to illustrate the effect of the jet divider 86 with its convex divider surface 88 in twin-jet valves with gas containing. By means of the two or four spray openings 25 in the perforated spray disc 21, two or four fuel jets are produced and sprayed into the spraying space 87 in a manner distributed between areas formed on both sides of the jet divider 86. The design according to the present invention of the jet divider 86 is not only expedient in the case of individual fuel et which are directed at the jet divider 86 but also when the fuel jets are directed past the jet divider 86 or move apart with increasing distance from the spray openings 25. The fuel jets are struck perpendicularly by the gas emerging from the annular gas gap 83 immediately after they emerge from the spray openings 25. As a result, the separation of the two fuel jets is put at risk by the gas containing and the two fuel jets may even come together since the gas moves the fuel jets towards one another, as indicated by the dotted lines 90. In contrast to wedge-shaped or knife-edged jet dividers, gas backs up above the divider surface 88 in the case of jet dividers 86 with a convex divider surface 88, the stagnation pressure of the gas forcing the fuel jets apart again in an outwards direction and clear separation of the two jets thus being maintained. This effect of the stagnation pressure of the gas only occurs in the case of a jet divider 86 with a convex divider surface 88, whereas, in the case of a wedge-shaped or knife-edged jet divider, any stagnation pressure which does form is negligible. The convex jet divider 86 acts as a flow resistance, causing stagnation-region flow. The stagnation-region flow is responsible for the very compact jet division in the region of the jet divider 86 and the good preparation effect of the gas containing by virtue of improved mixing of the gas and the fuel. Wedgeshaped or knife-edged jet dividers do not separate the two jets properly if there is gas containing since the fuel jets move towards one another again downstream of the jet divider. Only jet dividers with a wedge-shaped or knife-edged cross-section which are very long in the direction of flow achieve the same effect as the convex jet dividers 86 with a small extent in the axial direction. The dash-dotted lines 91 show the patterns of fuel jets in twin-jet valves without gas containing. The convex divider surface 88 of the jet divider 86 ensures that separation of the two jets is just as good downstream of the jet divider 86 in the axial direction, despite the gas containing. The merging of the dotted line 90 into the dash-dotted line 91 is intended to illustrate this.

Figure 6:
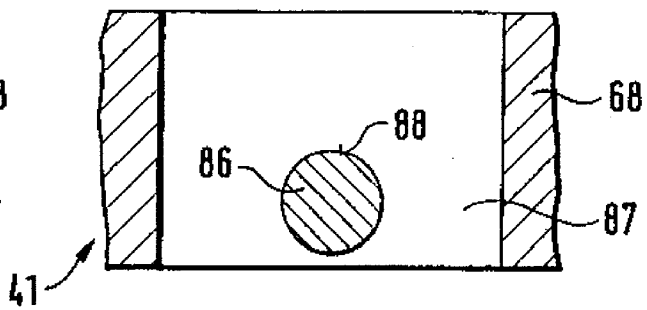
FIG. 6 shows a third exemplary embodiment illustrating the configuration of the spraying space surrounded by the gas containing body, with a jet divider having a circular cross-section, according to the present invention.
Figure 5:
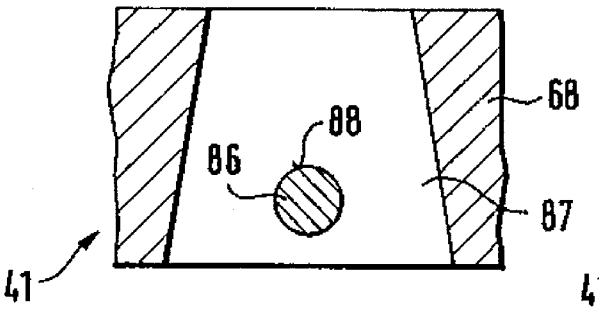
FIG. 5 shows a second exemplary embodiment illustrating the configuration of the spraying space surrounded by the gas containing body, with a jet divider having a circular cross-section, according to the present invention.
Figure 4:
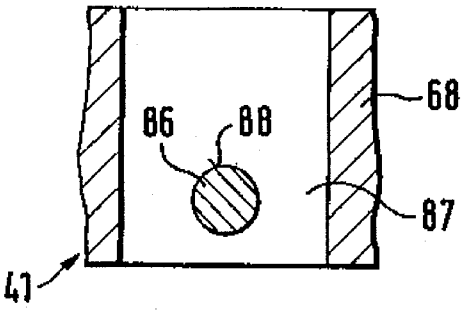
FIG. 4 shows a first exemplary embodiment illustrating the configuration of the spraying space surrounded by the gas containing body, with a jet divider having a circular cross-section, according to the present invention.
Figure 6A:
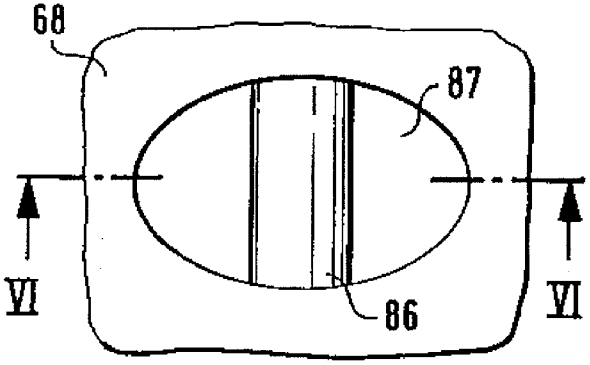
FIG. 6*a* shows a plan view of the configuration shown in FIG. 6.
Figure 5A:
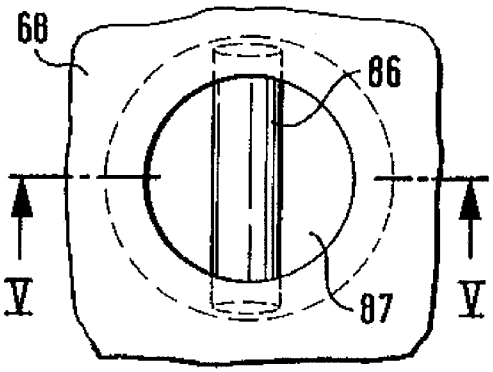
FIG. 5*a* shows a plan view of the configuration shown in FIG. 5.
Figure 4A:
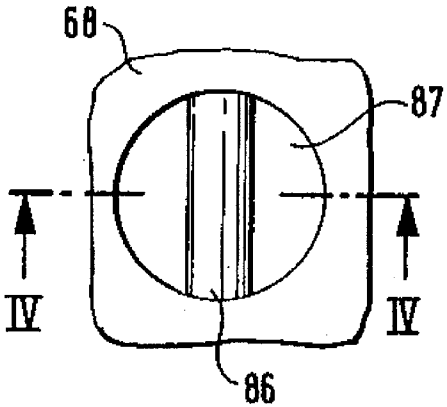
FIG. 4*a* shows a plan view of the configuration shown in FIG. 4.

By using gas containing body 41 with different geometries for the spraying pace 87 and the jet divider 86, it is possible to achieve the widest possible variety of injection-valve jet angles. A multiplicity of possible geometries of the fuel/gas mixture sprayed can be achieved just by varying the gas containing body 41 and the jet divider 86. FIGS. 4 to 6 and 4*a* to 6*a* how, schematically, exemplary embodiments of the configuration of the spraying space 87 surrounded by the gas containing body 41, with a jet divider 86 which has a circular cross-section. The exemplary embodiment in FIG. 4 illustrates a cylindrical spraying space 87 in the region of the jet divider 86; FIG. 5 shows a conical spraying space 87 like that shown in FIGS. 1 and 3; and FIG. 6 shows an elliptical spraying space 87. FIGS. 4*a* to 6*a* are plan views of the spraying spaces 87 shown in FIGS. 4 to 6.

Figure 7:
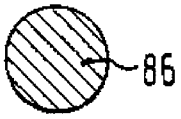
FIG. 7 shows a central cross-sectional view of a first exemplary embodiment of a convex jet divider according to the present invention.
Figure 8:
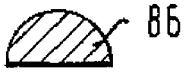
FIG. 8 shows a central cross-sectional view of a second exemplary embodiment of a convex jet divider according to the present invention.
Figure 9:
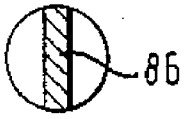
FIG. 9 shows a central cross-sectional view of a third exemplary embodiment of a convex jet divider according to the present invention.
Figure 7A:
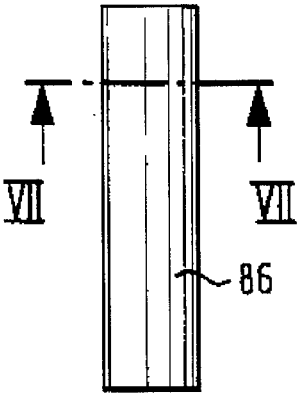
FIG. 7*a* shows a plan view of the jet divider shown in FIG. 7.
Figure 8A:
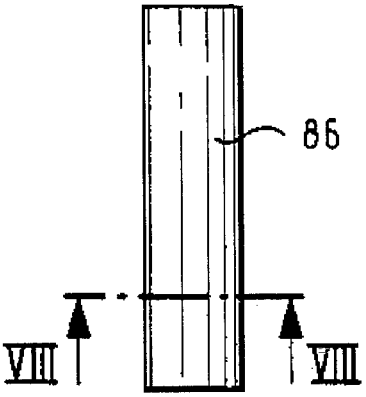
FIG. 8*a* shows a plan view of the jet divider shown in FIG. 8.
Figure 9A:
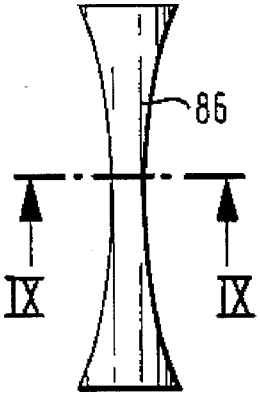
FIG. 9*a* shows a plan view of the jet divider shown in FIG. 9.
Figure 10:
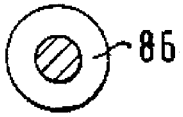
FIG. 10 shows a central cross-sectional view of a fourth exemplary embodiment of a convex jet divider according to the present invention.
Figure 11:
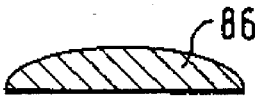
FIG. 11 shows a central cross-sectional view of a fifth exemplary embodiment of a convex jet divider according to the present invention.
Figure 12:
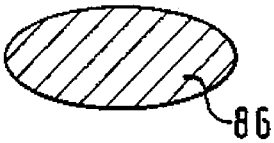
FIG. 12 shows a central cross-sectional view of a sixth exemplary embodiment of a convex jet divider according to the present invention.
Figure 10A:
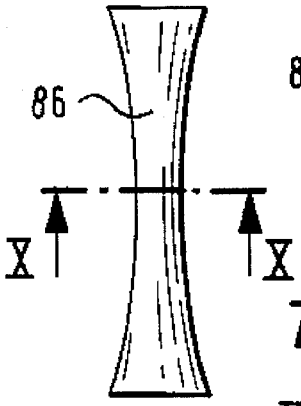
FIG. 10*a* shows a plan view of the jet divider shown in FIG. 10.
Figure 11A:
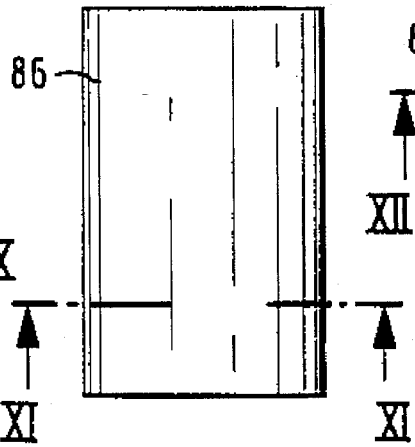
FIG. 11*a* shows a plan view of the jet divider shown in FIG. 11.
Figure 12A:
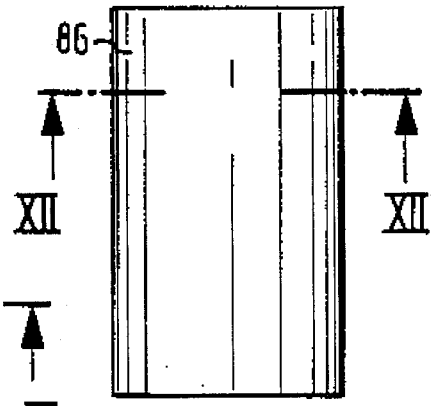
FIG. 12*a* shows a plan view of the jet divider shown in FIG. 12.
Figure 13:
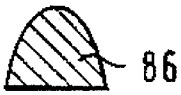
FIG. 13 shows a central cross-sectional view of a seventh exemplary embodiment of a convex jet divider according to the present invention.
Figure 14:
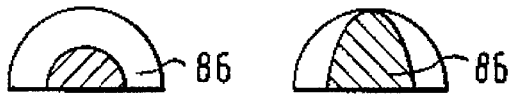
FIG. 14 shows a central cross-sectional view of a eighth exemplary embodiment of a convex jet divider according to the present invention.
Figure 13A:
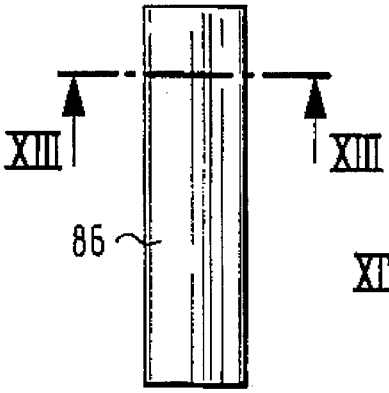
FIG. 13*a* shows a plan view of the jet divider shown in FIG. 13.
Figure 14A:
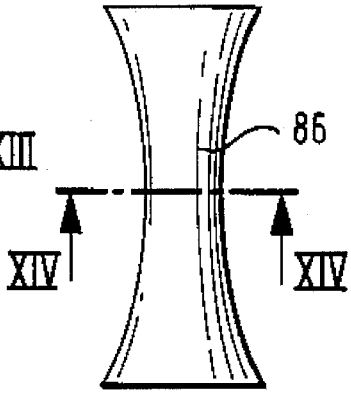
FIG. 14*a* shows a plan view of the jet divider shown in FIG. 14.
Figure 15:
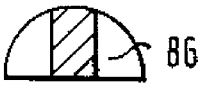
FIG. 15 shows a central cross-sectional view of a ninth exemplary embodiment of a convex jet divider according to the present invention.
Figure 16:
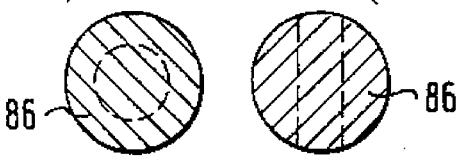
FIG. 16 shows a central cross-sectional view of a tenth exemplary embodiment of a convex jet divider according to the present invention.
Figure 17:
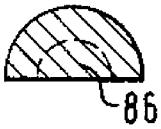
FIG. 17 shows a central cross-sectional view of a eleventh exemplary embodiment of a convex jet divider according to the present invention.
Figure 15A:
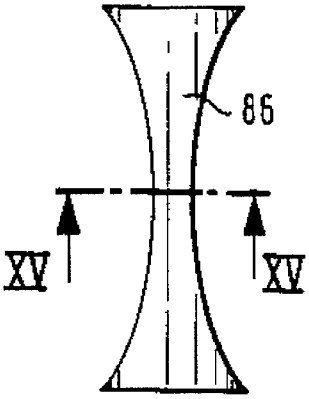
FIG. 15*a* shows a plan view of the jet divider shown in FIG. 15.
Figure 16A:
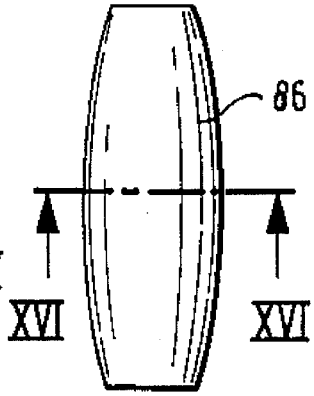
FIG. 16*a* shows a plan view of the jet divider shown in FIG. 16.
Figure 17A:
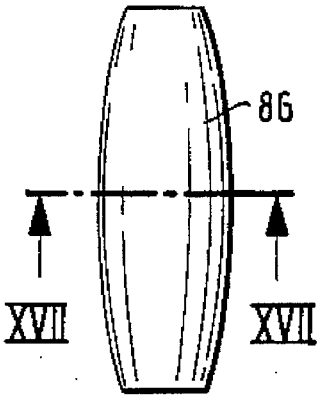
FIG. 17*a* shows a plan view of the jet divider shown in FIG. 17.

A number of possible variants of the configuration of the convex jet dividers 86 are shown schematically and in simplified form as cross-sections and plan views in FIGS. 7 to 17 and 7*a* to 17*a*, respectively. The decisive factor in the design of the jet dividers 86 is the convex divider surface 88. The variants shown make possible different jet angles of the fuel/gas mixture. In addition to jet dividers 86 with a circular (FIGS. 7, 7*a*), semicircular (FIGS. 8, 8*a*), elliptical (FIGS. 12, 12*a*), semi-elliptical (FIGS. 11, 11*a*) or some other rounded cross-sections (FIGS. 9, 9*a*, 13, 13*a*, 15, 15*a*), it is also possible to conceive of jet dividers 86 which, transverse to the flow and, for example, in their central area, have waist-shaped constrictions (FIGS. 9, 9*a*, 10, 10*a*, 14, 14*a*, 15, 15*a*) for small jet angles or bulges (FIGS. 16, 16*a*, 17, 17*a*) for larger jet angles.

We claim:

1. An injection valve for injecting a fuel mixture into an internal combustion engine, the fuel mixture emerging through a mixture spray opening, the injection valve having a longitudinal axis, comprising:

a movable valve-closing body;

a valve-seat body disposed at a downstream end of the injection valve, the valve-seat body including a valve-seat surface that interacts with the valve-closing body;

a perforated spray disc arranged downstream of the valve-seat surface, the perforated spray disc having at least two spray openings;

a gas containing body surrounding the downstream end of the injection valve at least partially in an axial direction and at least partially in a radial direction;

a jet divider arranged downstream of the mixture spray opening, the jet divider including a convex divider surface, the convex divider surface extending transversely to the longitudinal axis, facing the perforated spray disc, and providing a stagnation-region flow, for maintaining a separation of fuel jets which are sprayed out of the spray openings and which are not directed to the jet divider.

2. The injection valve according to claim 1, wherein the valve is an electromagnetically-actuated fuel injection valve.

3. The injection valve according to claim 1, wherein the gas containing body at least partially surrounds the perforated spray disc.

4. The injection valve according to claim 1, wherein the jet divider is formed as a web and is part of the gas containing body.

5. The injection valve according to claim 1, wherein the jet divider is a separate component secured in the gas containing body.

6. The injection valve according to claim 1, wherein the jet divider has a circular cross-section.

7. The injection valve according to claim 1, wherein the jet divider has a semi-circular cross-section.

8. The injection valve according to claim 1, wherein the jet divider has an elliptical cross-section.

9. The injection valve according to claim 1, wherein the jet divider has a semi-elliptical cross-section.

10. The injection valve according to claim 1, wherein the jet divider has at least one waist-shaped constriction.

11. The injection valve according to claim 1, wherein the jet divider has at least one bulge.

12. The injection valve according to claim 1, wherein the jet divider is arranged in a spraying space downstream of the mixture spray opening.

13. The injection valve according to claim 12, wherein the spraying space is of cylindrical configuration in a direction of flow.

14. The injection valve according to claim 12, wherein the spraying space is of widening configuration in a direction of flow.

15. The injection valve according to claim 12, wherein the spraying space is of elliptical configuration in a direction of flow.

16. The injection valve according to claim 1, wherein the gas containing body surrounds a spraying space downstream of the mixture spray opening.

17. An injection valve for injecting a fuel mixture into an internal combustion engine, the fuel mixture emerging through a mixture spray opening, the injection valve having a longitudinal axis, comprising:

a movable valve-closing body;

a valve-seat body disposed at a downstream end of the injection valve, the valve-seat body including a valve-seat surface that interacts with the valve-closing body;

a perforated spray disc arranged downstream of the valve-seat surface, the perforated spray disc having at least two spray openings;

a gas containing body surrounding the downstream end of the injection valve at least partially in an axial direction and at least partially in a radial direction;

a jet divider arranged downstream of the mixture spray opening, the jet divider including a convex divider surface, the convex divider surface extending transversely to the longitudinal axis, facing the perforated spray disc, and providing a stagnation-region flow, for maintaining a separation of fuel jets which are sprayed out of the spray openings and which are not directed to the jet divider; and a sheet-metal insert, the mixture spray opening being formed in the sheet-metal insert.

18. An injection valve for injecting a fuel mixture into an internal combustion engine, the fuel mixture emerging through a mixture spray opening, the injection valve having a longitudinal axis, comprising:

a movable valve-closing body;

a valve-seat body disposed at a downstream end of the injection valve, the valve-seat body including a valve-seat surface that interacts with the valve-closing body;

a perforated spray disc arranged downstream of the valve-seat surface, the perforated spray disc having at least two spray openings;

a gas containing body surrounding the downstream end of the injection valve at least partially in an axial direction and at least partially in a radial direction;

a jet divider arranged downstream of the mixture spray opening, the jet divider including a convex divider surface, the convex divider surface extending transversely to the longitudinal axis, facing the perforated spray disc, and providing a stagnation-region flow, for maintaining a separation of fuel jets sprayed out of the spray openings;

a sheet-metal insert, the mixture spray opening being formed in the sheet-metal insert, the sheet metal insert being of fructoconical shape, and the mixture spray opening being arranged in a radial area adjoined in a downstream direction by a conically extending area, the conically extending area tapering towards the perforated spray disc.

19. The injection valve according to claim 18, wherein the sheet-metal insert is clamped between the gas containing body and the perforated spray disc.

20. The injection valve according to claim 19, wherein the gas containing body clamps the sheet-metal insert in the conically extending area.

21. An injection valve for injecting a fuel mixture into an internal combustion engine, the fuel mixture emerging through a mixture spray opening, the injection valve having a longitudinal axis, comprising:

a movable valve-closing body;

a valve-seat body disposed at a downstream end of the injection valve, the valve-seat body including a valve-seat surface that interacts with the valve-closing body;

a perforated spray disc arranged downstream of the valve-seat surface, the perforated spray disc having at least two spray openings;

a gas containing body surrounding the downstream end of the injection valve at least partially in an axial direction and at least partially in a radial direction;

a jet divider arranged downstream of the mixture spray opening, the jet divider including a convex divider surface, the convex divider surface extending transversely to the longitudinal axis, facing the perforated spray disc, and providing a stagnation-region flow, for maintaining a separation of fuel jets sprayed out of the spray openings;

a sheet-metal insert, the mixture spray opening being formed in the sheet-metal insert, the sheet-metal insert including a plurality of knobs having an axial height, the knobs facing the perforated spray disc in the axial direction, an annular gas gap being formed between the perforated spray disc and the sheet-metal insert, the annular gas gap serving as a metering cross-section for a supplied gas.

* * * * *